US008191338B2

(12) United States Patent
Hägemann

(10) Patent No.: US 8,191,338 B2
(45) Date of Patent: Jun. 5, 2012

(54) INSERTING APPARATUS AND METHOD FOR PLACING A PRODUCT IN AN ENVELOPE USING SUCH AN INSERTING APPARATUS

(75) Inventor: Eckhard Hägemann, Bielefeld (DE)

(73) Assignee: W+D Direct Marketing Solutions GmbH, Lohne (DE)

( * ) Notice: Subject to any disclaimer, the term of this patent is extended or adjusted under 35 U.S.C. 154(b) by 306 days.

(21) Appl. No.: 12/373,474

(22) PCT Filed: Jul. 12, 2006

(86) PCT No.: PCT/EP2006/006877
§ 371 (c)(1),
(2), (4) Date: Apr. 29, 2009

(87) PCT Pub. No.: WO2008/006392
PCT Pub. Date: Jan. 17, 2008

(65) Prior Publication Data

US 2009/0313950 A1 Dec. 24, 2009

(51) Int. Cl.
*B65B 1/04* (2006.01)

(52) U.S. Cl. ..... 53/266.1; 53/284.3; 53/467; 270/58.06

(58) Field of Classification Search ..... 53/460, 53/206, 381.6, 386.1, 284.3, 569, 266.1, 53/467; 270/58.06
See application file for complete search history.

(56) References Cited

U.S. PATENT DOCUMENTS

| | | | | |
|---|---|---|---|---|
| 5,090,181 | A | 2/1992 | Foster et al. | |
| 5,168,689 | A | 12/1992 | Macelis | |
| 5,413,326 | A * | 5/1995 | Wright | 271/225 |
| 5,653,438 | A | 8/1997 | Crowley et al. | |
| 6,102,391 | A | 8/2000 | Malick et al. | |
| 6,789,377 | B2 * | 9/2004 | Sting et al. | 53/569 |
| 6,957,521 | B2 * | 10/2005 | Botschek et al. | 53/284.3 |
| 6,959,526 | B2 | 11/2005 | Sting | |

FOREIGN PATENT DOCUMENTS

| | | | |
|---|---|---|---|
| DE | 102 20 908 | C1 | 6/2003 |
| EP | 0 182 713 | A | 5/1986 |
| EP | 1 304 306 | A2 | 4/2003 |
| FR | 2 798 373 | A1 | 3/2001 |
| WO | WO-03/061988 | A | 7/2003 |

* cited by examiner

*Primary Examiner* — Thanh K Truong
(74) *Attorney, Agent, or Firm* — Birch, Stewart, Kolasch & Birch, LLP

(57) ABSTRACT

An inserting apparatus for placing a product in an envelope is provided with a discharge path. The discharge path is provided with a skewed roller conveyer which comprises a plurality of rollers arranged at an angle relative to the discharge conveying direction, to align the envelopes along a stop extending in the conveying direction of the roller conveyer. The discharge path is provided with at least one pressing device extending above the roller conveyor to press envelopes towards the roller conveyor, the pressing device comprising at least one array of vertically moveable, rotatable balls. The roller conveyor is provided with at least one endless transport belt for the envelopes, extending opposite the at least one pressing device, the endless belt extending substantially transversally with respect to the rollers.

14 Claims, 10 Drawing Sheets

INSERTING APPARATUS AND METHOD FOR PLACING A PRODUCT IN AN ENVELOPE USING SUCH AN INSERTING APPARATUS

BACKGROUND OF THE INVENTION

1. Field of the Invention

The present invention relates to an inserting apparatus and method, and more particularly to an inserting apparatus and method for placing a product in an envelope using such an inserting apparatus 2. Background of the Invention The invention relates to an apparatus provided with:

- a product assembly path comprising a product conveyor and at least one feeder for feeding a, possibly composite, product which is to be placed in an envelope,
- an inserting module provided with a magazine for envelopes and a positioning device for positioning the envelopes in a receiving position, in which receiving position, in use, the product coming from the product assembly path is placed in the envelope,
- a discharge path in which the envelope with the product placed therein is discharged from the inserting module for further processing, wherein the discharge path has a discharge conveying direction which is substantially perpendicular to the conveying direction of the inserting apparatus.

Such an apparatus is known from practice and has been marketed by applicant. The known apparatus is of modular structure and is provided with a product assembly path which comprises a number of feeders which are arranged along or above a pusher conveyor. Each feeder feeds a product to be placed in an envelope to a position on the pusher conveyor, so that thus composite products can be obtained. Such a product can comprise, for instance, a main document with a number of annexes. Next, the product, which may or may not be composite, is supplied to an inserting module.

The international patent application WO03061988, of the applicant, describes an advantageous embodiment of the apparatus, an example of which is shown in FIGS. 1-2. This apparatus comprises a product assembly path 1 having a pusher conveyor 2 and at least one feeder 4 for feeding a, possibly composite, product which is to be placed in an envelope. Herein, the inserting module is provided with an endless conveyor 12' with grippers 13' (see FIG. 2), such as, for instance, a toothed belt or chain with grippers, the endless conveyor 12' following a path such that the grippers 13' thereof can engage an envelope contained in the magazine and, as a result of the travel of the conveyor, can pull the envelope from the magazine. The grippers 13' can position a respective envelope in another part of the path in the receiving position.

In this known apparatus, the conveying direction of the mentioned discharge path is perpendicular to the conveying direction of the inserting module. Three endless conveyor belts 22, 23, 24 are provided (see FIG. 2), wherein one conveying part of a first conveyor belt 22 is disposed at least partly against a conveying part of a second conveyor belt 23. The envelope with product advanced by the intermediate conveyor is moved into the nip defined by the two conveyor belts, so that the envelope with product is clamped between the two conveying parts. Thereafter, the envelope can be conveyed further (in a inclined upward direction) and ejected onto the discharge path. The discharge path is provided with a stop 30' against which products supplied by the discharge conveyor belts come to abut, so that they are aligned. The known discharge path is provided with a vacuum conveyor belt and with sealing means not represented in the drawing, for sealing the envelope. These sealing means comprise, for instance, an apparatus for wetting the sealing flap of the envelope and a guideway for gradually folding over the sealing flap during advancement of the envelope along the discharge path. Instead of a wetting device, a hot-melt glue dispensing unit may be provided. During use, the known apparatus can move an envelope with product further between the conveying parts of the conveyor belts until it comes to lie against the stop to be subsequently discharged in the discharge path in transverse direction.

SUMMARY OF THE INVENTION

The present invention aims to provide an improved inserting apparatus. Particularly, the invention aims to provide an inserting apparatus that can handle a large range of products into envelopes of a large range of sizes, weights and thicknesses, reliably and rapidly.

Advantageously, the apparatus is characterized in that the discharge path is provided with a skewed roller conveyer which comprises a plurality of rollers arranged at an angle relative to the discharge conveying direction, to align the envelopes along a stop extending in the conveying direction of the roller conveyer.

Therefore, alignment of the envelopes can be carried out fast and reliably, to that the envelopes can subsequently be closed and sealed in a sealing station that is preferably located downstream with respect to the skewed roller conveyer. Also, the skewed roller conveyor can handle envelopes having a large range of thicknesses (measured in vertical direction) due to varying envelop content. As an example, one envelope filled with a thin product (for example a letter) can be thin, whereas a next envelope to be processed by the apparatus can be much thicker (for example, in case the next envelope contains one or more thick booklets, brochures or the like). The present apparatus can cope with such variation of envelopes in-line, in a continuous process. Besides, each envelope can be filled such with product, that the filled envelope is not flat but has a certain relief (for example, in the case that the envelope contains sheets of paper in combination with a small object such as a pencil or small present). Such 'irregularly' filled envelopes can also be processed reliably, accurately and swiftly by the present apparatus.

In a further embodiment, the discharge path is provided with at least one pressing device extending above the roller conveyor to press envelopes towards the roller conveyor, the pressing device comprising at least one array of vertically moveable, rotatable balls.

Herein, preferably, each of the balls is positioned above a respective roller of the skewed roller conveyor, to press an envelope towards that roller during use. Also, preferably, the roller conveyor can be provided with a endless grip enhancing belt, for example a belt of elastic material for example rubber, extending opposite the pressing device, to provide a smooth transfer of envelopes that reach between the roller conveyer and the pressing device.

In a preferred embodiment, the mentioned stop is a resilient stop, configured to at least partially absorb impact of an incoming envelope by resiliently counteracting such impact.

Thus, envelopes can be transmitted from the inserting module at high speeds towards that stop, preferably in a first horizontal direction, and be decelerated rather abruptly by the stop (due to the stop resiliently absorbing the impact of the envelope), wherein the roller conveyer preferably immediately takes over the conveying of the envelope (decelerated in the first direction), particularly in a second horizontal direction that is perpendicular to the mentioned first horizontal direction. Thus, product-filled envelopes of various weights (for example having a total mass in the range of 8 grams to 1 kg, or a different mass) can be aligned fast and reliable.

Also, a mentioned pressing device can be used to at least partly decelerate each incoming envelope (the envelope being discharged by the inserting module), by the moving balls of the pressing device absorbing kinetic energy from the inbound envelope.

In a further embodiment, the mentioned discharge path extends at the same vertical level as the receiving position in which, in use, the product coming from the product assembly path is placed in the envelope.

Therefore, a product-filled envelope can be handled on substantially the same vertical level, and does not have to be transferred upwardly to a sealing station. In this way, chances that a filled envelope looses product during the transfer to (for example) a sealing station can be diminished.

Also, an embodiment of the invention provides a method for placing a product in an envelope using an apparatus according to the invention. Herein, the envelope is taken from a magazine, wherein a gripper brings the envelop to a receiving position where the gripper releases the envelope in a position in which the envelop abuts against a first stop. The, possibly composite, product is supplied from a product assembly path, and is being slid into the envelope disposed in the receiving position Then, preferably, the envelope is being transferred in a first direction (for example by a vacuum belt conveyor) onto the roller conveyer which first direction is perpendicular to a conveying direction of the roller conveyor, wherein the roller conveyor aligns the envelope with respect to a second stop and transfers the thus aligned envelope to a sealing device for sealing the envelope.

Further elaborations of the inserting apparatus according to the invention are described in the dependent claims and will hereinafter, together with the method according to the invention, be further elucidated with reference to the drawing.

DETAILED DESCRIPTION OF THE PREFERRED EMBODIMENTS

In the present application, similar or corresponding features are denoted by similar or corresponding reference signs.

Figure 3:
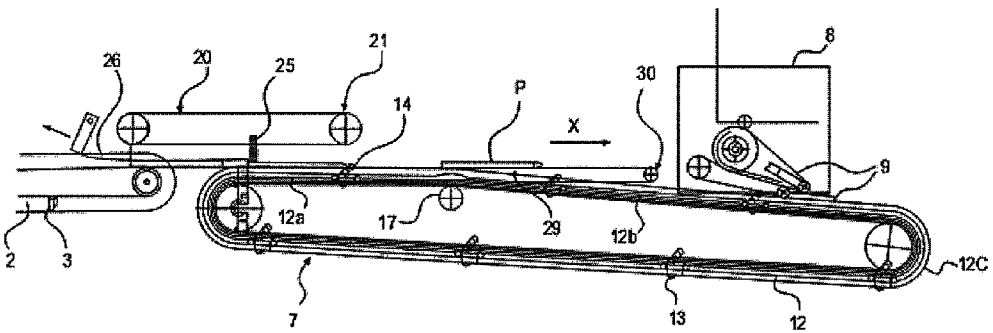
FIG. 3 schematically shows a front view of part of an apparatus according to an embodiment of the present invention.

FIG. 3 shows part of an embodiment of an inserting apparatus. The apparatus is provided with:

- a product assembly path 1 comprising a product conveyor 2 and at least one feeder 4 for feeding a, possibly composite, product which is to be placed in an envelope,
- an inserting module 7 provided with a magazine 8 for envelopes and a positioning device 12 for positioning the envelopes in a receiving position, in which receiving position, in use, the product coming from the product assembly path is placed in the envelope,
- a discharge path in which the envelope with the product placed therein is discharged from the inserting module 7 for further processing, wherein the discharge path has a discharge conveying direction Y (herein also called the second direction Y) which is substantially perpendicular (or transverse) to the conveying direction X of the inserting apparatus (also called the first direction X).

Figure 1:
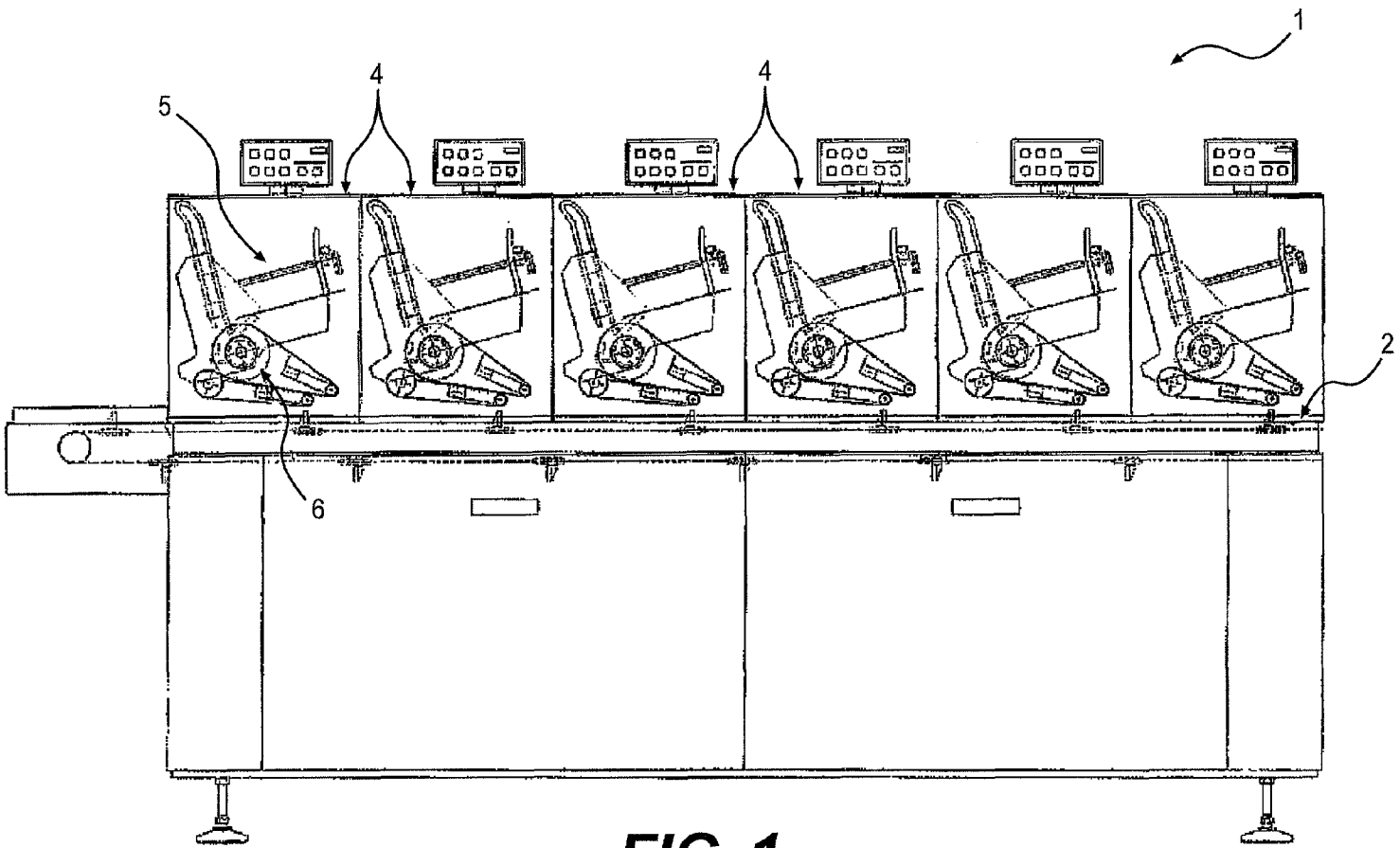
FIG. 1 PRIOR ART
FIG. 1 shows a front view of the product assembly path of a known inserting apparatus.
Figure 2:
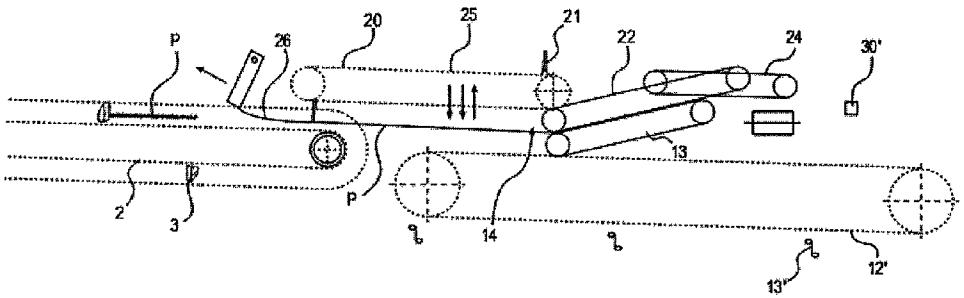
FIG. 2 PRIOR ART
FIG. 2 schematically shows a front view of an inserting module of the known apparatus.

For example, the product assembly path and inserting module can be substantially the same as the product assembly path and inserting module described and shown in international publication WO03061988 (see also FIGS. 1 and 2 to that aim).

For example, the grippers of the endless conveyor thereof can engage an envelope contained in the magazine and, as a result of the travel of the conveyor, can pull the envelope from the magazine, and the grippers can position a respective envelope in another part of the path in the receiving position (see FIG. 2).

Alternatively, means can be provided to push envelopes from the magazine into the grippers, when the grippers pass the magazine. This is depicted in FIG. 3. In this case, the envelop magazine 8 comprises conveyors that can take envelopes from a stack, and can push the envelopes into passing grippers 13 of an endless conveyor 12. For example, the grippers 13 can automatically grip envelopes pushed therein, to transfer the envelopes to a mentioned product receiving position at a first stop 14. Also, the grippers 13 can automatically release a gripped envelope in case the envelope has been positioned in that receiving position.

The inserting module (see FIGS. 2 and 3) can be provided with intermediate conveyor means which are arranged for taking over the conveyance of the P from the pusher conveyor 2 of the product assembly path 1 (see also FIG. 1). In the present exemplary embodiment, the intermediate conveyor means are designed as an endless conveyor 20 with pushers 21. The endless intermediate conveyor 20 is driven with a controllable drive, so that the speed with which the product can be slid into the envelope by the intermediate conveyor 20 can be varied. The intermediate conveyor 20 takes over the conveyance of the product, which is initially effected by the pusher 3 of the pusher conveyor 2 of the product assembly path 1, and slides the product into an envelope which is disposed in the receiving position. During or directly after sliding the product into the envelope, the stop 14 is brought into the release position, so that the product, together with the envelope, can be conveyed to a second, elongated, stop 30 (or discharge stop), located along the discharge path. For example, a first vacuum belt 29 can be provided to carry out the transfer of the envelopes from the inserting module towards the second stop 30 (see below).

Further, in FIG. 3 it is visible that the inserting module can be provided with a suction cup 25 for pulling up an opening edge of the envelope disposed in the receiving position. Further, a movably arranged downholder 26 can be provided, for holding down the product to be inserted, under the pulled-up opening edge. The displacement of the movable downholder 26 involves a reciprocating movement for sliding the downholder into the opening of the envelope after the suction cup has pulled up the opening edge.

Figure 4:
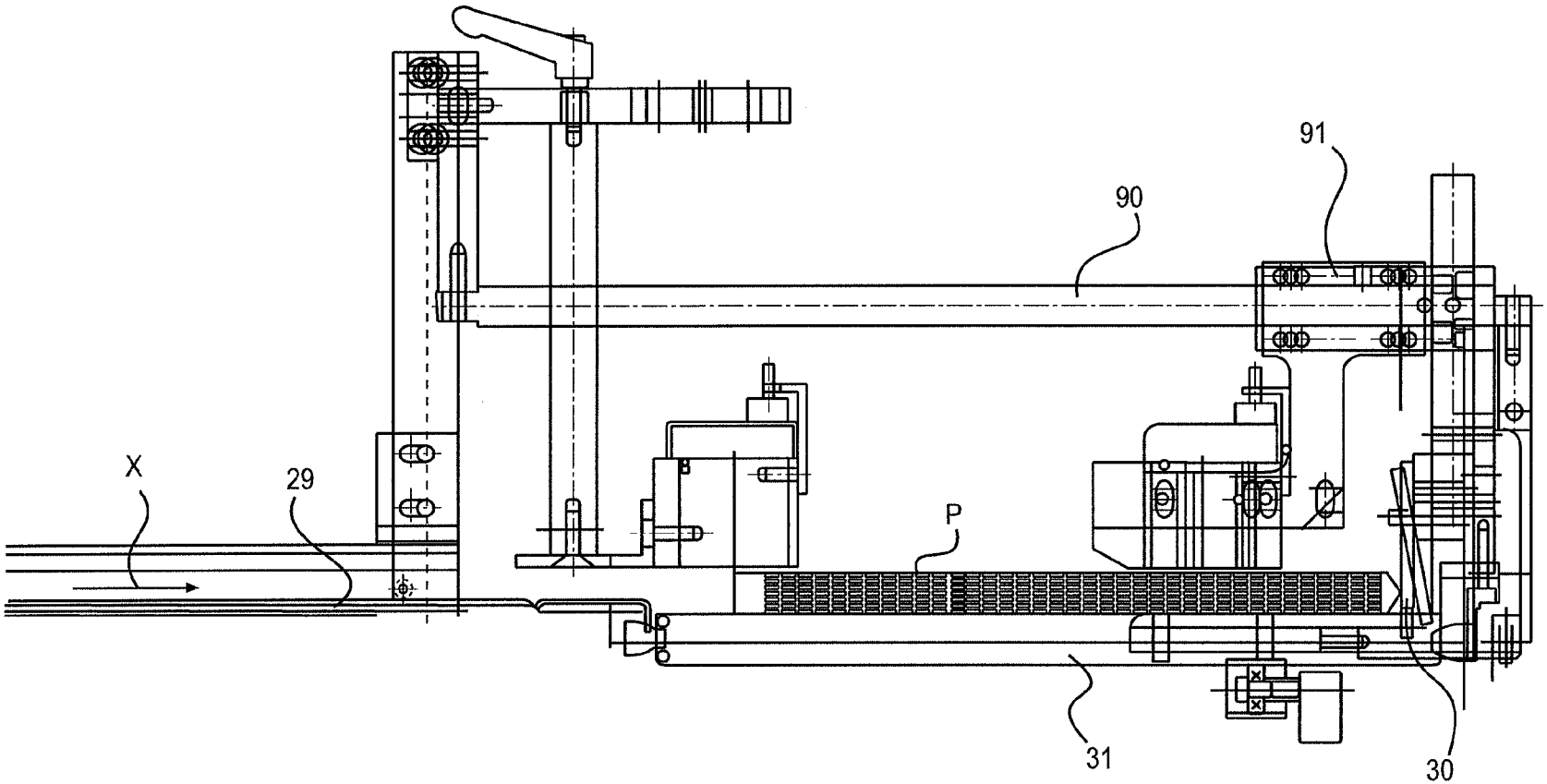
FIG. 4 is a detail of the embodiment shown in FIG. 3, showing a discharge-path downstream with respect to the inserting module.
Figure 5:
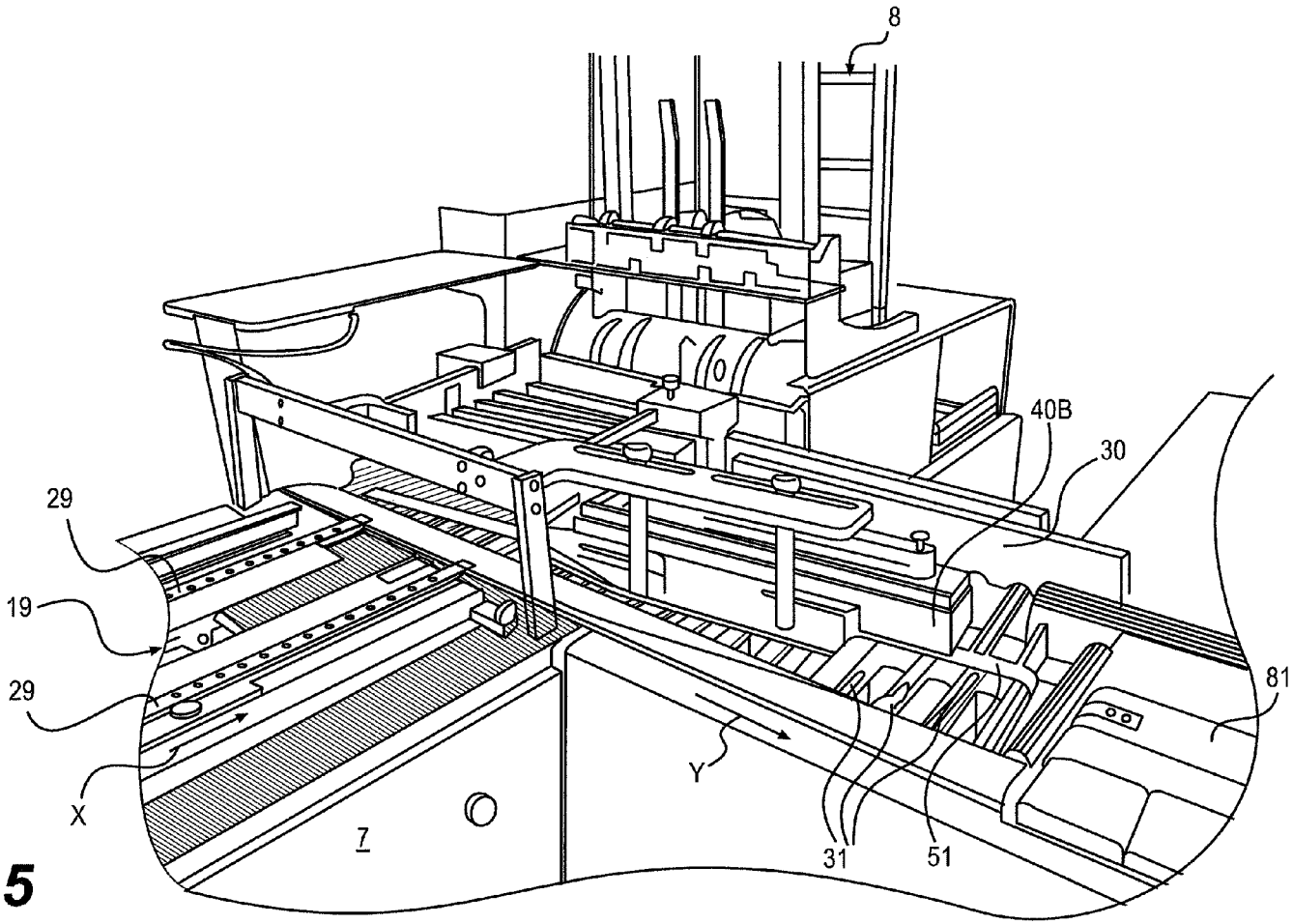
FIG. 5 is a perspective view of part of the embodiment shown in FIG. 3, showing the discharge path.

In the embodiment of FIG. 3, the discharge path extends at the same vertical level as the receiving position in which, in use, the product coming from the product assembly path is placed in the envelope. Thus, the stop 30 of the discharge path extends substantially at the same height as the product receiving position. A first vacuum conveyor 29, comprising a pair of suction belts in the present embodiment, is provided to transfer an envelope (for example filled with product) with high speed from the product receiving position towards the discharge path (see also FIGS. 4 and 5). For example, the first vacuum conveyor 29 can move envelopes at a speed higher than 1 m/s, for example 1.5 m/s or more, during use, in a conveying direction X of the inserting module. In the present embodiment, as an example, this conveying direction is equal to a conveying direction of the product assembly path 2. The suction belts of the first vacuum conveyor can be arranged symmetrically with respect to a centre line of a path to be taken by the envelopes.

Advantageously, the inserting module can be provided with the endless conveyor 12 with grippers 13, such as, for instance, a toothed belt or chain with grippers, the endless conveyor 12 following a path such that the grippers thereof can receive an envelope contained in the magazine 8, wherein the endless conveyor 12 is provided with a first upper part 12A for transferring the envelopes to the product receiving position, and a second part 12B extending below the level of the product receiving position (and reaching below a skewed roller conveyor 31, which is described in the following). This is shown in FIG. 3, wherein the second upper part 12B of the endless (gripper) conveyor 12 extends at an angle downwards with respect to the first upper part 12A, which extends in a substantially horizontal plane. An intermediate conveyor guide 17, for example comprising suitable guiding wheels, is provided, from which the second conveyor part extends towards a lower conveyor end part 12C, away from the level of the first vacuum conveyor 29. An opening or slit 19 (see FIG. 5, 6) can be provided in the plane of the vacuum conveyor 29, wherethrough upwardly protruding parts of the grippers 13 of the endless conveyor 12 (at its upper section) can be led downwardly. During use, the conveying speed of the endless conveyor 12 and the first vacuum conveyor 29 can be set such, that envelopes (filled at the product receiving position) do not run into upwardly protruding gripper parts of the endless conveyor 12 when the envelopes are moved towards the discharge path by the vacuum conveyor 29.

The configuration of the discharge path is depicted in more detail in FIGS. 4-12. In the present embodiment, the discharge path is provided with a skewed roller conveyer (or aligning conveyor) which comprises a plurality of parallel horizontal rollers 31 arranged at an angle relative to the discharge conveying direction Y, to align the envelopes along an envelope receiving surface 30A of the stop 30. The envelope receiving surface 30A of the alignment stop 30 extends transversally to the first direction X, and parallel to the conveying direction Y of the roller conveyer (see FIG. 6) and of a downstream sealing unit 80. For example, the angle between the rollers 31 and a normal of the stop 30 of the discharge path can be larger than 1°, for example in the range of about 5°-40°, particularly in the range of about 5°-20° and more particularly in the range of about 5°-10°.

The rollers 31 can be coupled to a motor 35 (see FIG. 11), via a suitable transmission, to rotate the rollers 31. The motor 35 can be configured many different ways and can include a controllable drive, for example an electromotor, as will be appreciated by the skilled person.

Figure 6:
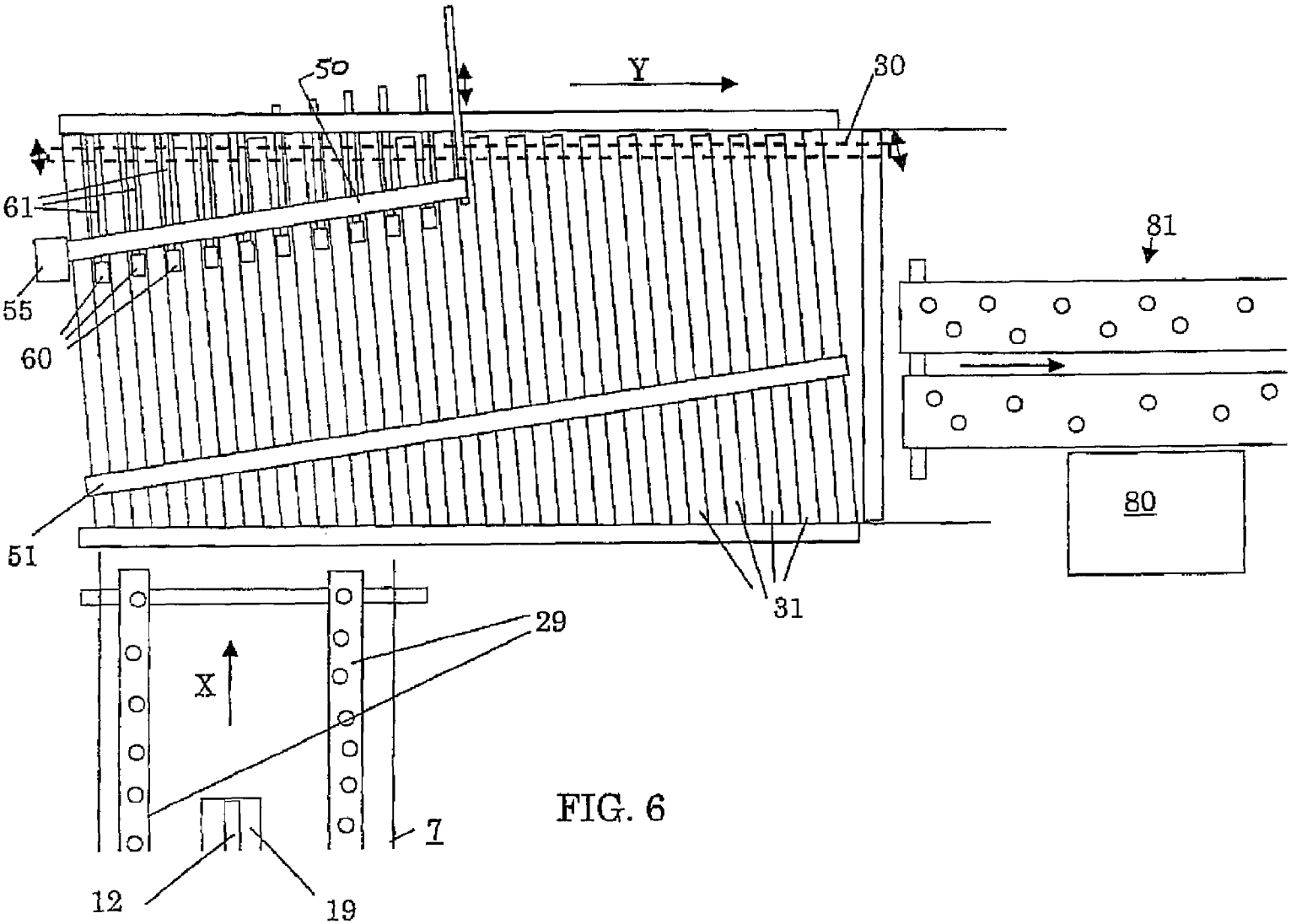
FIG. 6 is a schematic top view of the discharge path of the embodiment shown in FIG. 3, wherein the pressing devices are not depicted.
Figure 7:
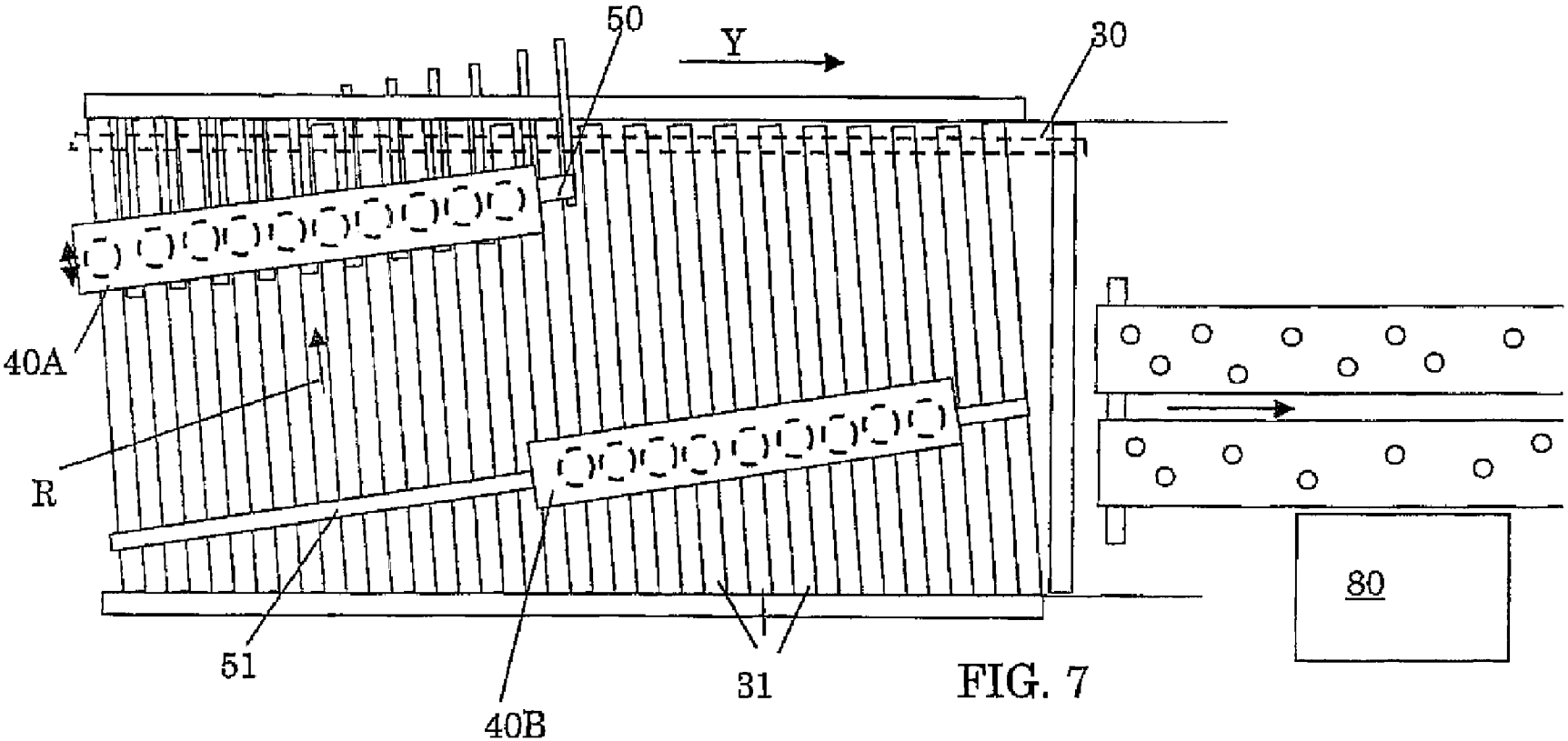
FIG. 7 is similar to FIG. 6, which does schematically depict the pressing devices.
Figure 10:
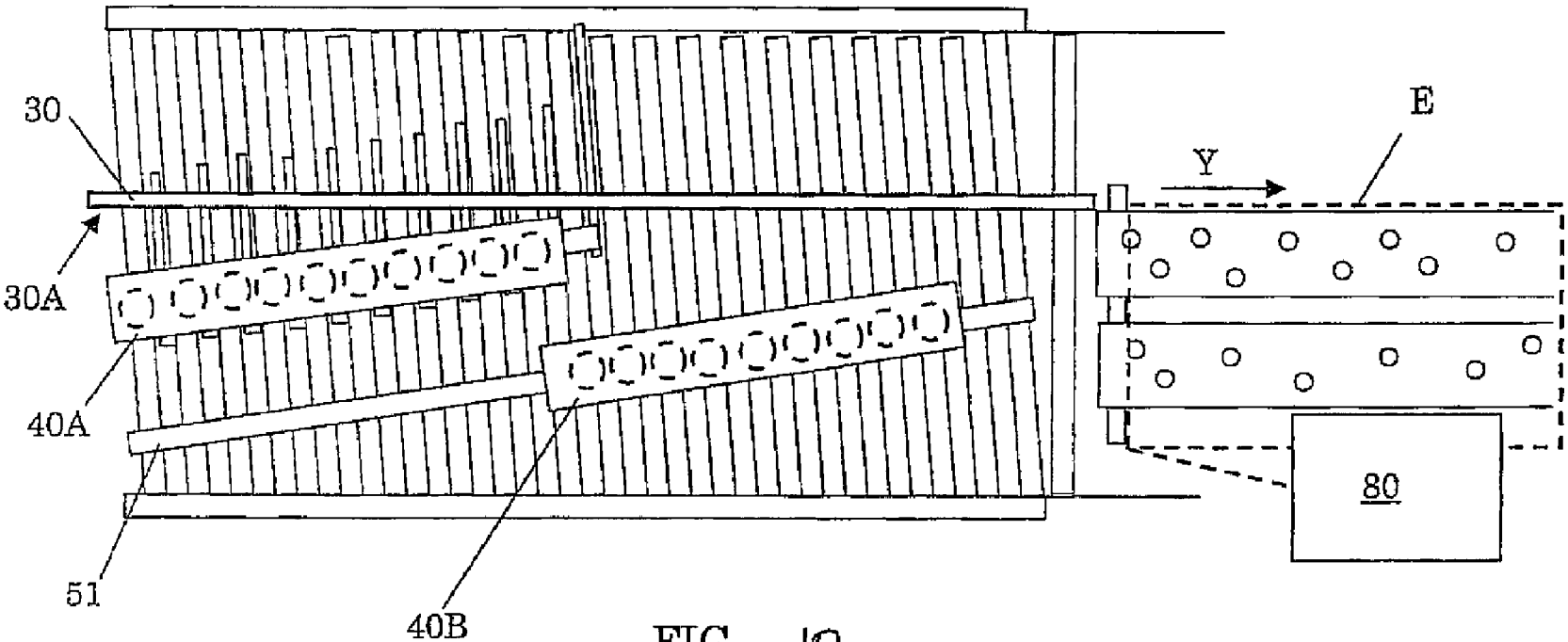
FIG. 10 is similar to FIG. 7, wherein the first pressing device, the stop and the first support belt have been moved to a second position.
Figure 11:
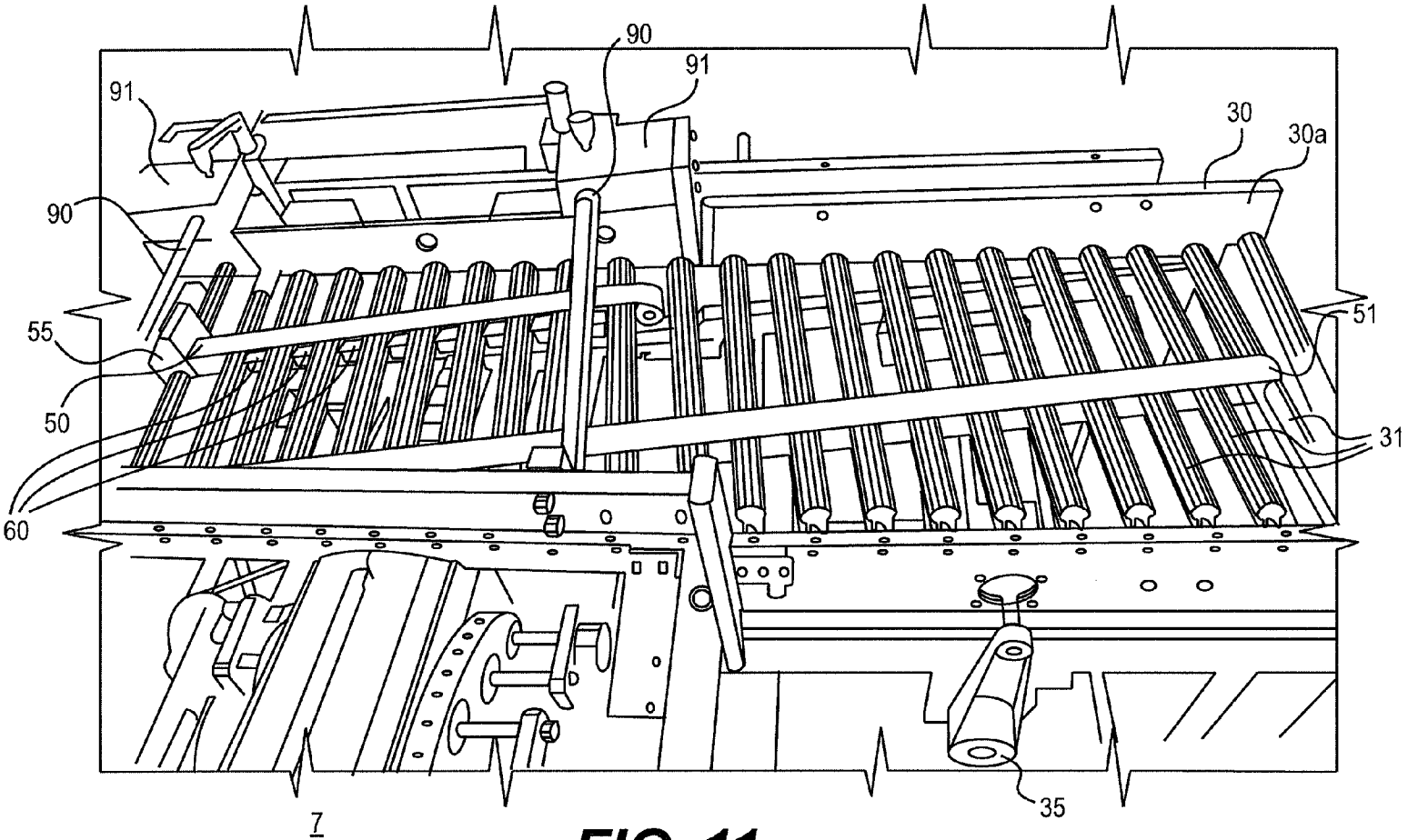
FIG. 11 is a perspective top view of the discharge path, without showing the pressing devices, indicating a first position of the stop and first support belt.
Figure 12:
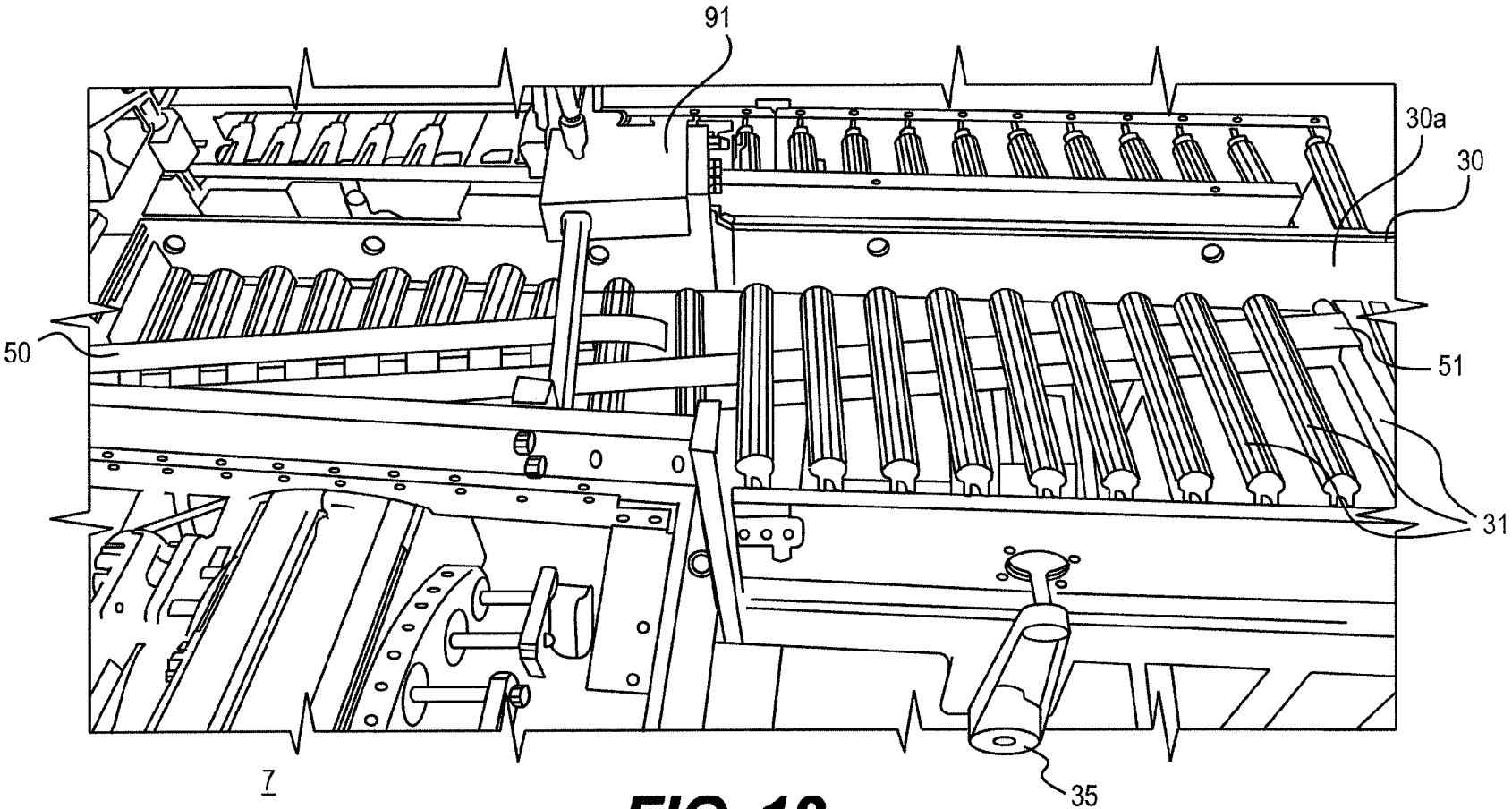
FIG. 12 is similar to FIG. 11, showing the stop and first support belt in their second position.

An operating position of the discharge stop 30 is at least adjustable in a transversal direction relative to the discharge conveying direction Y. A first stop 30 position is shown in FIGS. 6, 7, by dashed lines, and is visible in FIG. 11. In the first position, the stop 30 is moved away from a downstream end of the inserting module (or: of the first vacuum conveyor 29), to receive and align relatively large envelopes. A second stop position is shown in FIGS. 10, 12; in that position, the stop 30 has been moved over a certain distance towards the downstream end of the first vacuum conveyor 29, to align smaller envelopes. Particularly, the discharge (or alignment) stop 30 can be moved in parallel with respect to longitudinal directions of the skewed rollers 31, to adjust the transversal position of that stop 30.

Preferably, the discharge stop 30 is a resilient stop, configured to at least partially absorb impact of an incoming envelope by resiliently counteracting such impact. For example, envelopes can be emitted at high speeds from the inserting module 7 towards the stop 30. The resilient stop 30 can swiftly decelerate the incoming envelope, in the first direction X, without damaging the envelope and its contents. For example, the stop 30 can be provided with a layer of shock absorbing material, or with resilient material. Also, in an embodiment, the stop 30 can be held in position by spring means or spring devices, such that lateral movement of the stop 30 (in the X-direction) can be counteracted by the spring means/devices. Also, for example, the discharge stop 30 can be slightly pivotal or tiltable about a longitudinal axis (from a substantially vertical position to a tilted position), wherein such pivotal movement can be counteracted by one or more spring devices.

Downstream with respect of the skewed roller conveyor 31, a sealing module having a mentioned sealing device 80 is arranged. As has been mentioned above, the sealing device can comprise, for instance, an apparatus for wetting the sealing flap of the envelope and a guideway for gradually folding over the sealing flap during advancement of the envelope along the discharge path. Instead of a wetting device, a hot-melt glue dispensing unit may be provided. Also, the sealing module can comprise, for example, a second vacuum conveyor 81, to move the envelopes away from a downstream end of the skewed roller conveyor 31 and along the sealing device 80 (see FIG. 10, showing an envelope by dashed lines E). The conveying direction of the second vacuum conveyor 81 is the same as the second conveying direction Y, and is transversal with respect to the conveying direction X of the insertion module 7.

In the present embodiment, the discharge path is provided with two pressing devices 40, each extending above the roller conveyor 31 to press envelopes towards the roller conveyor. Preferably, each pressing device comprises an array of vertically moveable, rotatable loose balls (or spheres) 41. In the array, centers of the balls 41 are substantially located on the same virtual line. These pressing balls 41 are shown dashed in FIGS. 7, 10. Part of a pressing device is shown in more detail in FIG. 8. For example, each ball 41 can have sufficient mass to press an envelope gently in a direction towards the roller conveyor 31, by its weight, without damaging the envelop or its content. Also, the diameter of the balls can depend on the thickness of envelopes to be processed. As a non limiting example, the diameter of each ball can be in the range of 3 cm-10 cm. Also, as an example, each ball can be movable vertically over at least circa 0.5 cm, for example in the range of 0.5-10 cm, particularly in the range of example in the range of 0.5-5 cm Each of the balls 41 can be made of various materials. For example, the balls 41 can be massive, solid spheres. Also, a pressing ball 41 can be made of a suitable plastic, metal, steel, glass, a composite substance, or one or more other materials.

Particularly, there is provided an upstream pressing device 40A extending above an upstream part of the roller conveyer 31, opposite (i.e. in front of) a downstream end of the an inserting module 7, as well as a downstream pressing device 40B extending above a downstream part of the roller conveyer to receive envelopes from the upstream part of the roller conveyer. Herein, the term "downstream end of the inserting module" means the end from which the envelopes are being discharged by the inserting module 7 to the discharge path (i.e., the downstream end of the first vacuum conveyor 29 in the present embodiment).

Preferably, an operating position of the upstream pressing device 40A is at least adjustable in a transversal direction relative to the discharge conveying direction Y, together with the alignment stop 30.

Figure 8:
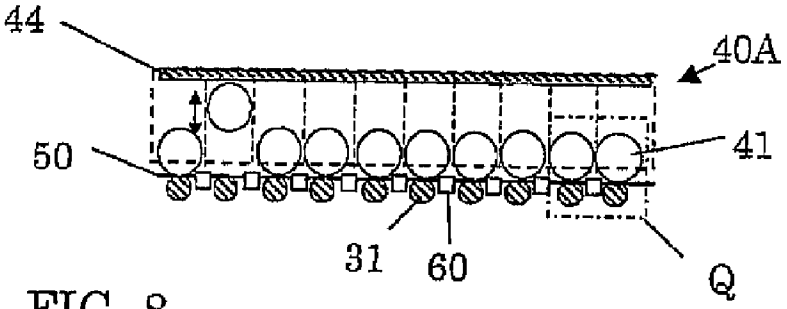
FIG. 8 schematically shows a side view of a pressing device, in a direction R of FIG. 7.

As is shown by dashed lines in FIG. 8, the pressing device 40A can be provided with separate pockets or chambers, each pocket holding a mentioned loose pressing ball 41 above the respective support belt. Besides, the interior space of the pressing device 40A is such, that the rotatable balls 41 are free to move or jump upwardly, over a certain distance.

Also, the pressing device 40A can be provided with a resilient ball stop or damper 44, extending above the balls 41 to limit upward movement of the balls 41. For example, the ball stop can be a layer 44 of resilient and/or soft material, for example cloth, foam, rubber or other material, which layer is spaced-apart from the balls 41 when they are in a lower position near the respective support belt 50 (see below) and skewed rollers 31. Also, the ball stop can be provided by suitable spring means. As an example, the inserting module 7 can be configured to shoot (or discharge) envelopes at high speed, in the conveying direction X of the inserting apparatus, towards lower surfaces of the balls 41 of the mentioned pressing device 40A (i.e., towards ball sides that are faced downwardly). The thrust of an incoming envelop can lead to the balls 41 of the upstream pressing device 40A jumping upwardly. Then, the resilient and/or soft material 41 extending above the balls can stop the balls 41, absorbing the respective impacts and damping or preventing noise.

Further, the roller conveyor 31 is provided with two endless, relatively narrow, support belts 50, 51, extending opposite the pressing devices 40. During use, these support belts 50, 51 can cooperate with the pressing devices 40 to transport envelopes (clamped between support belt and pressing device) towards a downstream end of the skewed roller conveyor. The support belts 50, 51 can be made of elastic, grip enhancing material, for example rubber, a suitable plastic or similar material. Particularly, the support belts 50, 51 are grip enhancing belts, configured to provide a good grip—via friction—to the envelopes.

Each of these endless support belts 50, 51 extends substantially transversally with respect to the rollers 31. The first support belt 50 is arranged opposite the downstream part of the inserting module, and extends around a number of the skewed rollers 31 (nine, in the present embodiment). A horizontal position of the first belt 50 is adjustable, in a direction parallel to the skewed rollers 31, together with the envelop alignment stop 30. As is shown, the first belt 50 is located between the stop 30 and the other support belt 51 (when viewed in top view, see FIG. 6, 11, 12), and extends in parallel with the other belt 51. In this configuration, an upstream part of the first support belt 50 is located further from the stop 30 than a downstream part of that belt 50. Opposite ends of the first support belt 50 are held by respective belt guides 55, 56, preferably to hold the belt 50 at a certain tension and in contact with the respective rollers 31.

The other support belt 51 extends around all of the skewed rollers 31. As is visible in FIG. 5, an upstream end of the second belt 51 is located at an upstream edge of the upstream roller 31 of the roller conveyer, near the downstream end of the first vacuum conveyor 29. An opposite downstream end of the second belt 51 is located at of near the middle of the most downstream skewed roller 31 of the roller conveyer, opposite the upstream end of the vacuum conveyor 81 of the sealing module (see FIGS. 5-6, 11-12). For example, the second support belt 51 can be held under a certain tension by the rollers of the skewed roller conveyor.

The support belts 50, 51 are also drivable by the motor 35. For example, the motor 35 can rotate the skewed rollers 31 and a mentioned belt guide 56, leading to the rollers 31 driving the support belts 50, 51. Also, the motor 35 can be coupled to one or both support belts 50, 51 to drive the belts directly. A transmission between the motor, belts 50, 51 and rollers 31 can be configured in many different ways, for example with gear wheels, transmission belts, as will be appreciated by the skilled person.

Figure 9B:
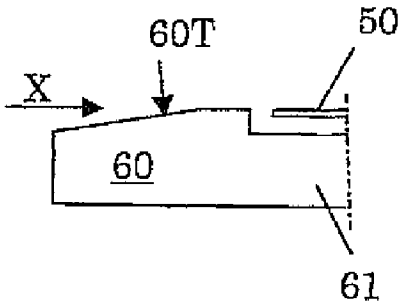
FIG. 9B is a front view part of a ramp element shown in FIG. 9A.
Figure 9A:
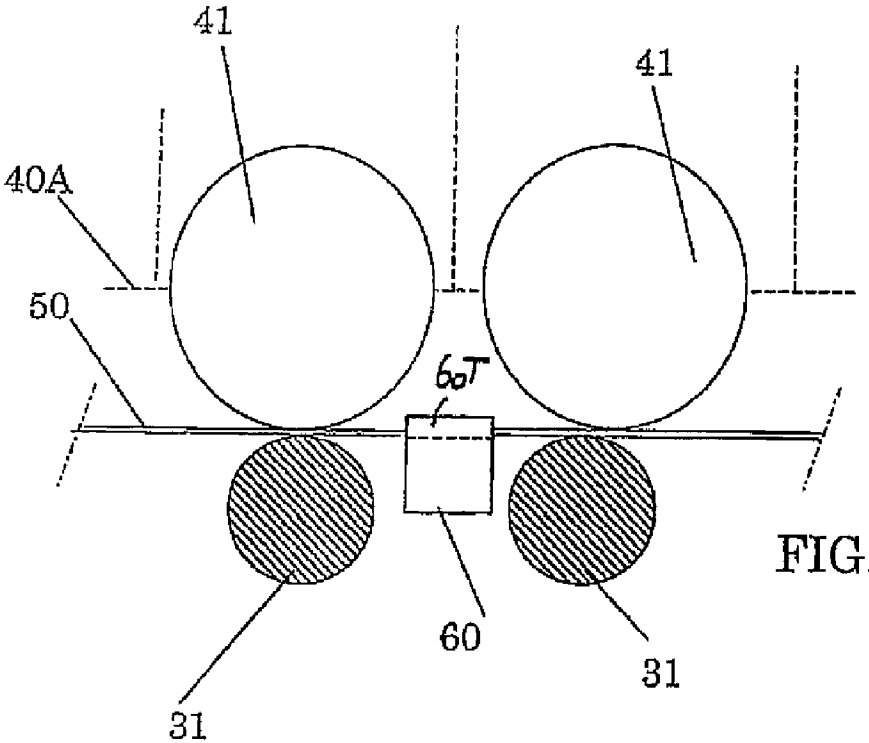
FIG. 9A is a detail Q of FIG. 8.

Besides, the apparatus preferably comprises a plurality of ramp elements 60 reaching upwardly between adjacent skewed rollers 31 of the roller conveyor and in front of an upper part of the upstream endless support belt 50, to prevent incoming envelopes, received from the inserting module 7, to become trapped between that endless belt 50 and the roller conveyor. FIGS. 9A, 9B depict an embodiment of a ramp element 60 in more detail. A top surface 60T of the ramp element 60 is slightly inclined with respect to a horizontal plane, to direct incoming envelops (transmitted by the first vacuum belt 29) slightly upwards, towards lower sides of the balls 41 of the upstream pressing device 40 and slightly away from the first support belt 50. As is shown in FIG. 9B, to this aim, the upwardly facing surface of the first support belt 50 can extend below the top of the ramp elements 60. Elongated holding members 61 can be provided, extending parallel to the skewed rollers 31 and through a space that is enclosed by the first support belt 50, to hold the ramp element 60 in front of the first support belt 50.

Also, preferably, an operating position of the ramp element 60 is at least adjustable in a transversal direction relative to the discharge conveying direction Y (see FIGS. 6, 7, 10, 11, 12), together with adjustment of the discharge path stop 30.

Adjustment means 90, 91 are provided, configured to provide the mentioned transversal adjustment of the stop 30, the first upstream pressing device 40A, the first support belt 50 and the respective ramp element holding members 61 with the ramp elements 60. In the present embodiment, these adjustment means comprise a guiding frame, having two parallel guiding bars 90 which extend in parallel with respect to the skewed rollers 31, spaced-apart above those rollers 31. Suspension members 91 are slidably coupled to the guiding bars 90, and can be positioned and fixed in various positions along the guiding bars 90. The suspension members 91 are coupled to the stop 30, the first upstream pressing device 40A, the first support belt 50 and the respective ramp elements 60, to hold (or suspend) these components at a desired position with respect to a location of the sealing device 80 (see FIG. 10). Thus, the position of the stop 30, the first upstream pressing device 40A, the first support belt 50 and the respective ramp elements 60, can be adjusted in a simple manner, at the same time, using the same adjusting mechanism. In the present embodiment, the adjustment means 90, 91 are manually operable, however, it will be clear that the adjusting can also be automated, for example in the case that the adjustment means are provided with actuators configured for providing automatic repositioning of the mentioned components 30, 40A, 50, 60, 61.

During use of the embodiment of FIGS. 3-12, envelopes E (preferably filled with one or more products P) can be emitted at high speeds by the first vacuum conveyor 29 in a respective conveying direction X (see FIG. 4-6), towards the envelop alignment stop 30. Herein, subsequent envelops can be filled with varying products, for example having a large range of thicknesses (measured in vertical direction with respect to the conveying direction). As a non-limiting example, the thickness of a filled envelope can range from less than circa 0.5 mm to several cm. The envelopes can be discharged towards the upper sides of the ramp elements 60, so that these elements guide the envelopes between lower surfaces of the pressing balls 41 of the first pressing device 40A and the upper part of the first support belt 50. The envelop can impact the pressing balls 41, leading to upward movement of the balls, which can also lead to a certain deceleration of the envelop (due to energy exchange with the pressing balls 41). A mentioned resilient ball stop or damper 44 can stop upwardly jumping pressing balls 41, so that the balls can return to a downward location for cooperation with the respective support belt 50, or at least can press downwardly towards the respective support belt 50.

Part of the envelop (and product therein), that has passed between the balls 41 and first support belt 50, can subsequently impact the resilient alignment stop 30, to be decelerated by that stop 30 in the first direction X. Each envelop is preferably received by the envelope receiving surface 30A of the alignment stop 30 along a full straight (bottom) envelope edge, at the same time, for achieving a desired impact absorption without damaging the envelop and its content.

The pressing balls 41 of the upstream pressing device 40A and the respective upstream support belt 50 can cooperate to accelerate and transport the respective envelope (reaching between the balls 41 and belt 50) in the second direction, such that the envelope is being brought into alignment with the envelop receiving surface 30A of the alignment stop. Also, the downstream pressing device 40B and second support belt 51 can take over the transport and alignment process of the envelop, and can transfer a thus aligned envelop to the sealing module 80 (see FIG. 10). In this way, the direction of travel of the envelops can be changed swiftly from the first conveying direction X into the second conveying direction Y, without substantially changing the envelope orientation (for example via rotation) in the horizontal conveying plane.

Depending on mass and size of an envelop, the impact of the envelop with the balls 41 of the upstream pressing device and with the resilient stop 30 can be such, that the envelop rebounds from the resilient stop 30 back towards the first vacuum conveyor 29, over a certain distance. Depending on the transversal position of the upstream pressing device/support belt assembly 40A, 50, the envelop rebound can be such that the envelop does not reach below the first pressing device 40A. In that case, the downstream pressing device 40B can still operate, to align the rebounded envelop along the discharge stop 30 (cooperating with the respective second support belt 51). Therefore, rebounded envelopes can still be aligned reliably and swiftly, to be further processed downstream of the skewed roller conveyor. Besides, the present apparatus can be made relatively compact, is reliable and durable.

It will be clear that the invention is not limited to the exemplary embodiment described, but that various modifications within the scope of the invention as defined by the claims are possible.

The invention claimed is:

1. An apparatus provided with:

a product assembly path comprising a product conveyor and at least one feeder for feeding a product which is to be placed in an envelope, an inserting module provided with a magazine for envelopes and a positioning device for positioning the envelopes in a receiving position, in which receiving position, in use, the product coming from the product assembly path is placed in the envelope, a discharge path in which the envelope with the product placed therein is discharged from the inserting module for further processing, wherein the discharge path has a discharge conveying direction which is substantially perpendicular to the conveying direction of the inserting apparatus, wherein the discharge path is provided with a skewed roller conveyer which comprises a plurality of rollers arranged at an angle relative to the discharge conveying direction, to align the envelopes along a stop extending in the conveying direction of the roller conveyer, wherein the discharge path is provided with at least one pressing device extending above the roller conveyor to press envelopes towards the roller conveyor, the pressing device comprising at least one array of vertically moveable, rotatable balls, and wherein the roller conveyor is provided with at least one endless transport belt in direct contact with the envelopes and extending opposite the at least one pressing device, the endless belt extending substantially transversally with respect to the rollers.

2. The apparatus according to claim 1, further comprising a plurality of ramp elements reaching upwardly between adjacent rollers of the roller conveyor and in front of an upper part of the endless belt, to prevent incoming envelopes, received from the inserting module, to become trapped between that endless belt and the roller conveyor.

3. The apparatus according to claim 2, wherein the inserting module is configured to shoot the envelopes at high speed, in the conveying direction of the inserting apparatus, towards lower surfaces of the balls of a mentioned pressing device.

4. The apparatus according to claim 2, wherein the pressing device is provided with a stop or damper, extending above the balls to limit upward movement of the balls.

5. The apparatus according to claim 2, comprising an upstream pressing device extending above an upstream part of the roller conveyer, opposite a downstream end of the an inserting module, and a downstream pressing device extending above a downstream part of the roller conveyer, to receive envelopes from the upstream part of the roller conveyer.

6. The apparatus according to claim 1, wherein the inserting module is configured to shoot the envelopes at high speed, in the conveying direction of the inserting apparatus, towards lower surfaces of the balls of a mentioned pressing device.

7. The apparatus according to claim 6, wherein the pressing device is provided with a stop or damper, extending above the balls to limit upward movement of the balls.

8. The apparatus according to claim 1, wherein the pressing device is provided with a stop or damper, extending above the balls to limit upward movement of the balls.

9. The apparatus according to claim 1, further comprising an upstream pressing device extending above an upstream part of the roller conveyer, opposite a downstream end of the an inserting module, and a downstream pressing device extending above a downstream part of the roller conveyer, to receive envelopes from the upstream part of the roller conveyer.

10. The apparatus according to claim 1, wherein an operating position of at least one pressing device is adjustable in a transversal direction relative to the discharge conveying direction.

11. The apparatus according to claim 1, wherein an operating position of the mentioned stop is adjustable in a transversal direction relative to the discharge conveying direction.

12. The apparatus according to claim 1, wherein the mentioned stop is a resilient stop, configured to at least partially absorb impact of an incoming envelope by resiliently counteracting such impact.

13. The apparatus according to claim 1, wherein the discharge path extends at the same vertical level as the receiving position in which, in use, the product coming from the product assembly path is placed in the envelope.

14. The apparatus according to claim 1, wherein the inserting module is provided with an endless conveyor with grippers, the endless conveyor following a path such that the grippers thereof can receive an envelope contained in the magazine, wherein the endless conveyor is provided with a first upper part for transferring the envelopes to the product receiving position, and a second part extending below the level of the product receiving position.

* * * * *